US006007407A

United States Patent [19]

Rutherford et al.

[11] Patent Number: 6,007,407

[45] Date of Patent: Dec. 28, 1999

[54] ABRASIVE CONSTRUCTION FOR SEMICONDUCTOR WAFER MODIFICATION

[75] Inventors: Denise R. Rutherford, Stillwater; Douglas P. Goetz, St. Paul; Cristina U. Thomas, Woodbury; Richard J. Webb, Inver Grove Heights; Wesley J. Bruxvoort, Woodbury, all of Minn.; James D. Buhler, Shringle Springs; William J. Hollywood, San Carlos, both of Calif.

[73] Assignees: Minnesota Mining and Manufacturing Company, St. Paul, Minn.; Exclusive Design Company, Inc., Fremont, Calif.

[21] Appl. No.: 08/915,058

[22] Filed: Aug. 20, 1997

Related U.S. Application Data

[63] Continuation of application No. 08/694,357, Aug. 8, 1996, Pat. No. 5,692,950.

[51] Int. Cl.[6] ..... B24B 5/00

[52] U.S. Cl. ..... 451/41; 451/552; 451/553; 451/534

[58] Field of Search ..... 457/41, 552

[56] References Cited

U.S. PATENT DOCUMENTS

| | | |
|---|---|---|
| 3,499,250 | 3/1970 | Jensen et al. . |
| 3,504,457 | 4/1970 | Jacobsen et al. . |
| 3,863,395 | 2/1975 | Brown . |
| 4,138,228 | 2/1979 | Hartfelt et al. . |
| 4,450,652 | 5/1984 | Walsh . |
| 4,512,113 | 4/1985 | Budinger . |
| 4,667,447 | 5/1987 | Barton . |

(List continued on next page.)

FOREIGN PATENT DOCUMENTS

| | | |
|---|---|---|
| 0 139 410 A1 | 5/1985 | European Pat. Off. . |
| 0 167 679 A1 | 1/1986 | European Pat. Off. . |
| 0 465 868 A2 | 1/1992 | European Pat. Off. . |
| 0 578 865 A1 | 1/1994 | European Pat. Off. . |
| 0 658 401 A1 | 6/1995 | European Pat. Off. . |
| 0 685 299 A1 | 12/1995 | European Pat. Off. . |
| 0 745 456 A1 | 12/1996 | European Pat. Off. . |
| 652171 | 10/1937 | Germany . |
| 323814 A1 | 3/1993 | Germany . |
| WO 91/14538 | 10/1991 | WIPO . |
| WO 94/04599 | 3/1994 | WIPO . |
| WO 97/11484 | 3/1997 | WIPO . |

OTHER PUBLICATIONS

"Standard Test Methods of Tension Testing of Metallic Foil", ASTM Designation: E 345–93, 376–380 (Oct. 1993).

"Standard Test Method for Measuring the Dynamic Mechanical Properties of Plastics in Compression", ASTM Designation: D 5024–94, 293–295 (Dec. 1994).

H.K. Tonshoff et al., "Abrasive Machining of Silicon", *Annals of the CIRP,* 39, 621–635 (1990).

"Standard Test Method for Tensile Properties of Plastics", ASTM Designation: D 638–84, 227–236 (Sep. 1984).

"Standard Methods for Stress Relaxation Tests for Materials and Structures", ASTM Designation: E 328–86, 445–456 (May 1986).

"Standard Test Methods for Tensile Properties of Thin Plastic Sheetings", ASTM Designation: D 882–88, 317–323 (Oct. 1988).

*Primary Examiner*—Robert A. Rose
*Assistant Examiner*—George Nguyen
*Attorney, Agent, or Firm*—Daniel R. Pastirik

[57] ABSTRACT

An abrasive construction for modifying a surface of a workpiece, such as a semiconductor wafer. The abrasive construction comprises: a three-dimensional, textured, fixed abrasive element; at least one resilient element generally coextensive with the fixed abrasive element; and at least one rigid element generally coextensive with and interposed between the resilient element and the fixed abrasive element, wherein the rigid element has a Young's Modulus greater than that of the resilient element.

14 Claims, 1 Drawing Sheet

U.S. PATENT DOCUMENTS

| | | | |
|---|---|---|---|
| 4,841,680 | 6/1989 | Hoffstein et al. . | |
| 4,879,258 | 11/1989 | Fisher . | |
| 4,927,432 | 5/1990 | Budinger et al. . | |
| 5,015,266 | 5/1991 | Yamamoto . | |
| 5,020,283 | 6/1991 | Tuttle . | |
| 5,104,421 | 4/1992 | Takizawa et al. . | |
| 5,152,917 | 10/1992 | Pieper et al. . | |
| 5,177,908 | 1/1993 | Tuttle . | |
| 5,197,999 | 3/1993 | Thomas . | |
| 5,212,910 | 5/1993 | Breivogel et al. | 451/527 |
| 5,257,478 | 11/1993 | Hyde et al. . | |
| 5,287,663 | 2/1994 | Pierce et al. . | |
| 5,289,032 | 2/1994 | Higgins, III et al. . | |
| 5,389,032 | 2/1995 | Beardsley . | |
| 5,453,312 | 9/1995 | Haas et al. . | |
| 5,500,273 | 3/1996 | Holmes et al. . | |
| 5,607,341 | 3/1997 | Leach . | |
| 5,607,346 | 3/1997 | Wilson et al. . | |
| 5,607,488 | 3/1997 | Wiand . | |
| 5,609,517 | 3/1997 | Lofaro . | |
| 5,624,303 | 4/1997 | Robinson . | |
| 5,643,044 | 7/1997 | Lund . | |
| 5,649,855 | 7/1997 | Chikaki . | |
| 5,692,950 | 12/1997 | Rutherford et al. | 451/41 |
| 5,733,176 | 3/1998 | Robinson et al. | 451/41 |

ABRASIVE CONSTRUCTION FOR SEMICONDUCTOR WAFER MODIFICATION

This is a continuation of application Ser. No. 08/694,357 filed Aug. 8, 1996 now U.S. Pat. No. 5,692,950.

BACKGROUND OF THE INVENTION

1. Field of Invention

This invention relates to an abrasive construction having abrasive, rigid, and resilient elements for modifying an exposed surface of a semiconductor wafer.

2. Description of the Related Art

In the course of integrated circuit manufacture, a semiconductor wafer typically undergoes numerous processing steps, including deposition, patterning, and etching steps. Additional details on how semiconductor wafers are processed can be found in the article "Abrasive Machining of Silicon" by Tonshoff, H. K.; Scheiden, W. V.; Inasaki, I.; Koning, W.; Spur, G. published in the *Annals of the International Institution for Production Engineering Research*, Volume 39/2/1990, pages 621 to 635. At each step in the process, it is often desirable to achieve a pre-determined level of surface "planarity" and/or "uniformity." It is also desirable to minimize surface defects such as pits and scratches. Such surface irregularities may affect the performance of a final patterned semiconductor device.

One accepted method of reducing surface irregularities is to treat the wafer surface with a slurry containing a plurality of loose abrasive particles using a polishing pad. An example of a polishing pad for use with a slurry is described in U.S. Pat. No. 5,287,663 (Pierce et al.). This pad includes a polishing layer, a rigid layer adjacent the polishing layer, and a resilient layer adjacent the rigid layer. The polishing layer is material such as urethane or composites of urethane.

SUMMARY OF THE INVENTION

The present invention provides an abrasive construction for modifying a surface of a workpiece. The abrasive construction comprises: a three-dimensional, textured, fixed abrasive element; at least one resilient element generally coextensive with the fixed abrasive element; and at least one rigid element generally coextensive with and interposed between the resilient element and the fixed abrasive element, wherein the rigid element has a Young's Modulus greater than that of the resilient element. The combination of the rigid and resilient elements with the abrasive element provides an abrasive construction that substantially conforms to the global topography of the surface of a workpiece while not substantially conforming to the local topography of a workpiece surface during surface modification.

Another embodiment of the abrasive construction comprises: a three-dimensional, textured, fixed abrasive article comprising a backing on which is disposed an abrasive coating, and a subpad generally coextensive with the backing of the fixed abrasive article. The subpad comprises: at least one resilient element having a Young's Modulus of less than about 100 MPa and a remaining stress in compression of at least about 60%; and at least one rigid element generally coextensive with and interposed between the resilient element and the backing of the fixed abrasive article, wherein the rigid element has a Young's Modulus that is greater than that of the resilient element and is at least about 100 MPa.

Yet another embodiment of the abrasive construction of the present invention comprises: a three-dimensional, textured, fixed abrasive article comprising a backing on which is disposed an abrasive coating; and a subpad. The subpad is generally coextensive with the backing of the fixed abrasive article and comprises: at least one resilient element having a Young's Modulus of less than about 100 MPa, a remaining stress in compression of at least about 60%, and a thickness of about 0.5–5 mm; and at least one rigid element generally coextensive with and interposed between the resilient element and the backing of the fixed abrasive article, wherein the rigid element has a Young's Modulus that is greater than that of the resilient element and at least about 100 MPa, and has a thickness of about 0.075–1.5 mm.

Throughout this application, the following definitions apply:

- "Surface modification" refers to wafer surface treatment processes, such as polishing and planarizing;
- "Rigid element" refers to an element which is of higher modulus than the resilient element and which deforms in flexure;
- "Resilient element" refers to an element which supports the rigid element, elastically deforming in compression;
- "Modulus" refers to the elastic modulus or Young's Modulus of a material; for a resilient material it is measured using a dynamic compressive test in the thickness direction of the material, whereas for a rigid material it is measured using a static tension test in the plane of the material;
- "Fixed abrasive element" refers to an integral abrasive element, such as an abrasive article, that is substantially free of unattached abrasive particles except as may be generated during modification of the surface of the workpiece (e.g., planarization);
- "Three-dimensional" when used to describe a fixed abrasive element refers to a fixed abrasive element, particularly a fixed abrasive article, having numerous abrasive particles extending throughout at least a portion of its thickness such that removing some of the particles at the surface during planarization exposes additional abrasive particles capable of performing the planarization function;
- "Textured" when used to describe a fixed abrasive element refers to a fixed abrasive element, particularly a fixed abrasive article, having raised portions and recessed portions in which at least the raised portions contain abrasive particles and binder;
- "Abrasive composite" refers to one of a plurality of shaped bodies which collectively provide a textured, three-dimensional abrasive element comprising abrasive particles and binder; the abrasive particles may be in the form of abrasive agglomerates; and
- "Precisely shaped abrasive composite" refers to an abrasive composite having a molded shape that is the inverse of the mold cavity which is retained after the composite has been removed from the mold; preferably, the composite is substantially free of abrasive particles protruding beyond the exposed surfaces of the shape before the abrasive article has been used, as described in U.S. Pat. No. 5,152,917 (Pieper et al.).

DETAILED DESCRIPTION OF INVENTION

Figure 1:
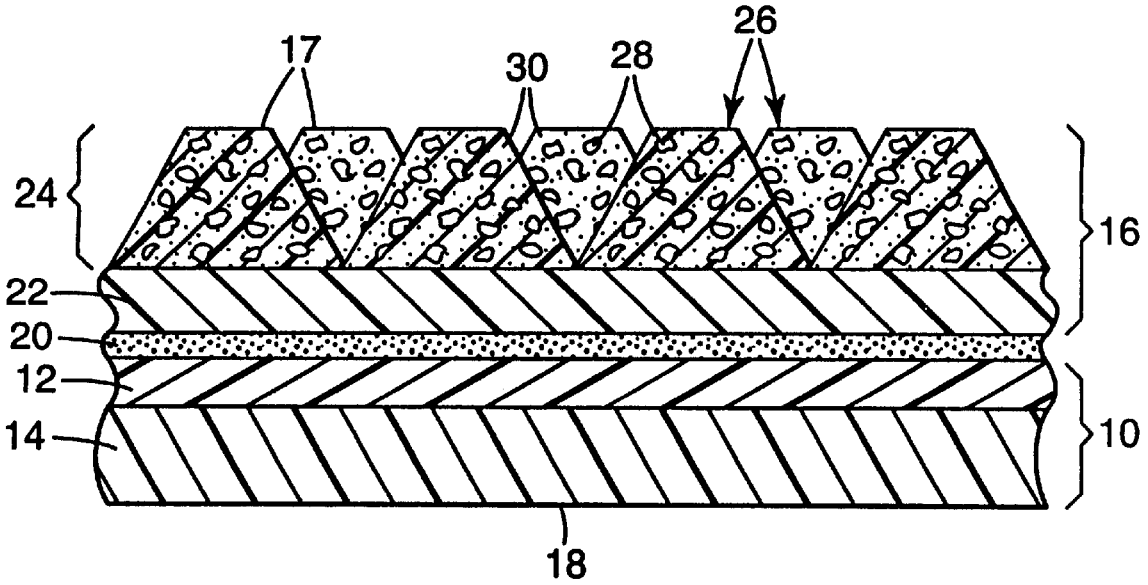
FIG. 1 is a cross-sectional view of a portion of the subpad of the present invention attached to a three-dimensional, textured, fixed abrasive element.

The present invention provides an abrasive construction for modifying an exposed surface of a workpiece such as a semiconductor wafer. The abrasive construction includes a three-dimensional, textured, fixed abrasive element, a resilient element, and a rigid element interposed between the resilient element and the fixed abrasive element. These elements are substantially coextensive with each other. The fixed abrasive element is preferably a fixed abrasive article. Suitable three-dimensional, textured, fixed abrasive articles, typically comprising a backing on which is disposed an abrasive coating that includes a plurality of abrasive particles and a binder in the form of a pre-determined pattern, and methods for using them in semiconductor wafer processing are disclosed in U.S. patent application Ser. No. 08/694,014, Attorney Docket No. 52034USA3E, filed on even date herewith, entitled "Method of Modifying An Exposed Surface of a Semiconductor Wafer," which is incorporated herein by reference.

The abrasive constructions of the present invention include at least one relatively high modulus rigid element and at least one lower modulus resilient element. Typically, the modulus of the resilient element (i.e., Young's Modulus in the thickness direction of the material) is at least about 25% (preferably at least about 50%) less than the modulus of the rigid element (i.e., Young's Modulus in the plane of the material). Preferably, the rigid element has a Young's Modulus of at least about 100 MPa, and the resilient element has a Young's Modulus of less than about 100 MPa. More preferably, the Young's Modulus of the resilient element is less than about 50 MPa.

The rigid and resilient elements provide a subpad for the abrasive element. As shown in FIG. 1, subpad 10 includes at least one rigid element 12 and at least one resilient element 14, which is attached to a fixed abrasive article 16. The rigid element 12 is interposed between the resilient element 14 and the fixed abrasive article 16, which has surfaces 17 that contact a workpiece. Thus, in the abrasive constructions of the present invention, the rigid element 12 and the resilient element 14 are generally cocontinuous with, and parallel to, the fixed abrasive article 16, such that the three elements are substantially coextensive. Although not shown in FIG. 1, surface 18 of the resilient element 14 is typically attached to a platen of a machine for semiconductor wafer modification, and surfaces 17 of the fixed abrasive article contacts the semiconductor wafer.

As shown in FIG. 1, this embodiment of the fixed abrasive article 16 includes a backing 22 having a surface to which is bonded an abrasive coating 24, which includes a predetermined pattern of a plurality of precisely shaped abrasive composites 26 comprising abrasive particles 28 dispersed in a binder 30. Abrasive coating 24 may be continuous or discontinous on the backing. In certain embodiments, however, the fixed abrasive article does not require a backing. Furthermore, the rigid element of the abrasive construction could be provided by the backing of the fixed abrasive article, at least in part.

Although FIG. 1 displays a textured, three-dimensional, fixed abrasive element having precisely shaped abrasive composites, the abrasive compositions of the present invention are not limited to precisely shaped composites. That is, other textured, three-dimensional, fixed abrasive elements are possible, such as those disclosed in U.S. patent application Ser. No. 08/694,014, Attorney Docket No. 52034USA3E, filed on even date herewith, entitled "Method of Modifying An Exposed Surface of a Semiconductor Wafer," which is incorporated herein by reference.

There may be intervening layers of adhesive or other attachment means between the various components of the abrasive construction. For example, as shown in FIG. 1, adhesive layer 20 is interposed between the rigid element 12 and the backing 22 of the fixed abrasive article 16. Although not shown in FIG. 1, there may also be an adhesive layer interposed between the rigid element 12 and the resilient element 14, and on the surface 18 of the resilient element 14.

During use, the surfaces 17 of the fixed abrasive article 16 contact the workpiece, e.g., a semiconductor wafer, to modify the surface of the workpiece to achieve a surface that is more planar and/or more uniform and/or less rough than the surface prior to treatment. The underlying combination of the rigid and resilient elements of the subpad provides an abrasive construction that substantially conforms to the global topography of the surface of the workpiece (e.g., the overall surface of a semiconductor wafer) while not substantially conforming to the local topography of the surface of the workpiece (e.g., the spacing between adjacent features on the surface of a semiconductor wafer) during surface modification. As a result, the abrasive construction of the present invention will modify the surface of the workpiece in order to achieve the desired level of planarity, uniformity, and/or roughness. The particular degree of planarity, uniformity, and/or roughness desired will vary depending upon the individual wafer and the application for which it is intended, as well as the nature of any subsequent processing steps to which the wafer may be subjected.

Although the abrasive constructions of the present invention are particularly suitable for use with processed semiconductor wafers (i.e., patterned semiconductor wafers with circuitry thereon, or blanket, nonpatterned wafers), they can be used with unprocessed or blank (e.g., silicon) wafers as well. Thus, the abrasive constructions of the present invention can be used to polish or planarize a semiconductor wafer.

The primary purpose of the resilient element is to allow the abrasive construction to substantially conform to the global topography of the surface of the workpiece while maintaining a uniform pressure on the workpiece. For example, a semiconductor wafer may have an overall shape with relatively large undulations or variations in thickness, which the abrasive construction should substantially match. It is desirable to provide substantial conformance of the abrasive construction to the global topography of the workpiece so as to achieve the desired level of uniformity after modification of the workpiece surface. Because the resilient element undergoes compression during a surface modification process, its resiliency when compressed in the thickness direction is an important characteristic for achieving this purpose. The resiliency (i.e., the stiffness in compression and elastic rebound) of the resilient element is related to the modulus of the material in the thickness direction, and is also affected by its thickness.

The primary purpose of the rigid element is to limit the ability of the abrasive construction to substantially conform to the local features of the surface of the workpiece. For example, a semiconductor wafer typically has adjacent features of the same or different heights with valleys between, the topography to which the abrasive construction should not substantially conform. It is desirable to attenuate conformance of the abrasive construction to the local topography of the workpiece so as to achieve the desired level of planarity of the workpiece (e.g., avoid dishing). The bending stiffness (i.e., resistance to deformation by bending) of the rigid element is an important characteristic for achieving this purpose. The bending stiffness of the rigid element is directly related to the in-plane modulus of the material and is affected by its thickness. For example, for a homogeneous material, the bending stiffness is directly proportional to its Young's Modulus times the thickness of the material raised to the third power.

The rigid and resilient elements of the abrasive constructions are typically separate layers of different materials. Each portion is typically one layer of a material; however, each element can include more than one layer of the same or different materials provided that the mechanical behavior of the layered element is acceptable for the desired application. For example, a rigid element can include layers of rigid and resilient materials arranged so as to give the required bending stiffness. Similarly, a resilient element can include layers of resilient and rigid materials as long as the overall laminate has sufficient resiliency.

It is also envisioned that the rigid and resilient elements can be made from materials having a gradation of modulus. For example, the role of the resilient element could be played by a foam with a gradient in the pore structure or crosslink density that provides lessening levels of rigidity throughout the thickness of the foam. Another example is a sheet of rigid material that has a gradient of filler throughout its thickness to vary its stiffness. Finally, a material designed to have a gradient in modulus throughout its thickness could be used to effectively perform the roles of both the rigid and the resilient elements. In this way, the rigid and resilient elements are integral within one layer of material.

The materials for use in the rigid and resilient elements are preferably selected such that the abrasive construction provides uniform material removal across the workpiece surface (i.e., uniformity), and good planarity on patterned wafers, which includes flatness (measured in terms of the Total Indicated Runout (TIR)), and dishing (measured in terms of the planarization ratio). The particular planarity values depend on the individual wafer and the application for which it is intended, as well as the nature of subsequent processing steps to which the wafer may be subjected.

The flatness quantity TIR is a well known term in the semiconductor wafer industry. It is a measure of the flatness of the wafer in a specified region of the wafer. The TIR value is typically measured along a line in a specified area of the semiconductor wafer using an instrument such as a TENCOR P-2 Long Scan Profilometer, available from Tencor of Mountain View, Calif. It is the distance between two imaginary parallel planes, one that intersects or touches the highest point of the surface of a semiconductor wafer and the other that intersects or touches the lowest point of the surface of the semiconductor wafer in the area of consideration. Prior to planarization, this distance (average of ten TIR readings) is typically greater than about 0.5 $\mu$m, sometimes greater than about 0.8 $\mu$m or even greater than about 1–2 $\mu$m. As a result of planarization, it is preferred that this distance be less than about 5000 Angstroms, preferably no more than about 1500 Angstroms.

As is well-known in the art, the amount of dishing is indicated by the planarization ratio, which compares the amount of material removed from the high regions, which are typically the desired regions of removal, to the amount of material removed from the low regions, where removal is typically not desired. Two instruments are used to measure the planarization ratio. A profilometer is used to measure TIR before and after planarization. An optical interference/absorption instrument is used to measure the thickness of the oxide layer in areas between metal interconnects, for example, before and after planarization. The amount of material removed from each area is determined and the planarization ratio calculated. The planarization ratio is the ratio of the amount of material removed from the high regions (typically the desired regions of removal) plus the amount of the material removed from the low regions (typically the regions where removal is not desired) divided by the amount of material removed from the high regions. In general, this planarization ratio should be less than 2. A planarization ratio of 1 is typically preferred because this indicates that there is effectively no dishing.

Uniformity of material removal across a workpiece surface, which is often reported along with removal or cut rate, is calculated by the following formula:

$$\%\ \text{uniformity}=[(\sigma_i^2+\sigma_f^2)^{1/2}/(h_i-h_f)]\times 100$$

wherein: $\sigma_i$ is the standard deviation of the initial material thickness; $\sigma_f$ is the standard deviation of the final material thickness; $h_i$ is the initial material thickness; $h_f$ is the final material thickness. Uniformities are preferably less than about 15%, more preferably less than about 10%, and most preferably less than about 5%.

The average cut rate depends upon the composition and topography of the particular wafer surface being treated with the abrasive construction. In the case of metal oxide-containing surfaces (e.g., silicon dioxide-containing surfaces), the cut rate should typically be at least about 100 Angstroms/minute, preferably at least about 500 Angstroms/minute, more preferably at least about 1000 Angstroms/minute, and most preferably at least about 1500 Angstroms/minute. In some instances, it may be desirable for this cut rate to be as high as at least about 2000 Angstroms/minute, and even 3000 or 4000 Angstroms/minute. While it is generally desirable to have a high cut rate, the cut rate is selected such that it does not compromise the desired topography of the wafer surface.

The choice of materials for the rigid and resilient elements will vary depending on the compositions of the workpiece surface and fixed abrasive element, the shape and initial flatness of the workpiece surface, the type of apparatus used for modifying the surface (e.g., planarizing the surface), the pressures used in the modification process, etc. As long as there is at least one rigid element and at least one resilient element, with at least one rigid element substantially coextensive with and interposed between the fixed abrasive element and the resilient element, the abrasive construction of the present invention can be used for a wide variety of semiconductor wafer modification applications.

The materials suitable for use in the subpad can be characterized using standard test methods proposed by ASTM, for example. Static tension testing of rigid materials can be used to measure the Young's Modulus (often referred to as the elastic modulus) in the plane of the material. For measuring the Young's Modulus of a metal, ASTM E345-93 (Standard Test Methods of Tension Testing of Metallic Foil) can be used. For measuring the Young's Modulus of an organic polymer (e.g., plastics or reinforced plastics), ASTM D638-84 (Standard Test Methods for Tensile Properties of Plastics) and ASTM D882-88 (Standard Tensile Properties of Thin Plastic Sheet) can be used. For laminated elements that include multiple layers of materials, the Young's Modulus of the overall element (i.e., the laminate modulus) can be measured using the test for the highest modulus material. Preferably, rigid materials (or the overall rigid element itself) have a Young's Modulus value of at least about 100 MPa. Herein, the Young's Modulus of the rigid element is determined by the appropriate ASTM test in the plane defined by the two major surfaces of the material at room temperature (20–25° C.).

Dynamic compressive testing of resilient materials can be used to measure the Young's Modulus (often referred to as the storage or elastic modulus) in the thickness direction of the material. Herein, for resilient materials ASTM D5024-94 (Standard Test Methods for Measuring the Dynamic Mechanical Properties of Plastics in Compression) is used, whether the resilient element is one layer or a laminated element that includes multiple layers of materials. Preferably, resilient materials (or the overall resilient element itself) have a Young's Modulus value of less than about 100 MPa, and more preferably less than about 50 MPa. Herein, the Young's Modulus of the resilient element is determined by ASTM D5024-94 in the thickness direction of the material at 20° C. and 0.1 Hz with a preload of 34.5 kPa.

Suitable resilient materials can also be chosen by additionally evaluating their stress relaxation. Stress relaxation is evaluated by deforming a material and holding it in the deformed state while the force or stress needed to maintain deformation is measured. Suitable resilient materials (or the overall resilient element) preferably retain at least about 60% (more preferably at least about 70%) of the initially applied stress after 120 seconds. This is referred to herein, including the claims, as the "remaining stress" and is determined by first compressing a sample of material no less than 0.5 mm thick at a rate of 25.4 mm/minute until an initial stress of 83 kPa is achieved at room temperature (20–25° C.), and measuring the remaining stress after 2 minutes.

The rigid and resilient elements of the abrasive constructions can be of a variety of thicknesses, depending on the Young's Modulus of the material. The thickness of each portion is chosen such that the desired planarity, uniformity, and roughness are achieved. For example, a suitable thickness for a rigid element with a modulus of 100 MPa is about 1.5 mm. Typically, however, the rigid element can be about 0.075–1.5 mm thick, depending on its modulus. Typically, as the Young's Modulus for a material increases, the required thickness of the material decreases. A suitable thickness for a resilient element with a modulus of less than about 100 MPa is typically about 0.5–5 mm preferably about 1.25–3 mm.

The rigid element is typically selected such that the abrasive construction is capable of not substantially conforming to the workpiece surface local topography over a gap width between features of at least about 1.2 mm, preferably at least about 1.5 mm, more preferably at least about 1.7 mm, and most preferably at least about 2.0 mm, when subjected to an applied pressure of about 80 kPa. This means that with gap widths smaller than the specified value, there will be no substantial conformance to local topography at this particular pressure. Generally, higher and lower pressures can be used without substantial conformance, as for example, the pressures typically experienced in wafer planarization. A significant advantage of the present invention is the ability to bridge larger gap widths, which is typically more difficult to achieve.

Rigid materials for use in the abrasive constructions can be selected from a wide variety of materials, such as organic polymers, inorganic polymers, ceramics, metals, composites of organic polymers, and combinations thereof Suitable organic polymers can be thermoplastic or thermoset. Suitable thermoplastic materials include, but are not limited to, polycarbonates, polyesters, polyurethanes, polystyrenes, polyolefins, polyperfluoroolefins, polyvinyl chlorides, and copolymers thereof Suitable thermosetting polymers include, but are not limited to, epoxies, polyimides, polyesters, and copolymers thereof As used herein, copolymers include polymers containing two or more different monomers (e.g., terpolymers, tetrapolymers, etc.).

The organic polymers may or may not be reinforced. The reinforcement can be in the form of fibers or particulate material. Suitable materials for use as reinforcement include, but are not limited to, organic or inorganic fibers (continuous or staple), silicates such as mica or talc, silica-based materials such as sand and quartz, metal particulates, glass, metallic oxides, and calcium carbonate.

Metal sheets can also be used as the rigid element. Typically, because metals have a relatively high Young's Modulus (e.g., greater than about 50 GPa), very thin sheets are used (typically about 0.075–0.25 mm). Suitable metals include, but are not limited to, aluminum, stainless steel, and copper.

Specific materials that are useful in the abrasive constructions of the present invention include, but are not limited to, poly(ethylene terephthalate), polycarbonate, glass fiber reinforced epoxy boards (e.g., FR4, available from Minnesota Plastics, Minneapolis, Minn.), aluminum, stainless steel, and IC 1000 (available from Rodel, Inc., Newark, Del.).

Resilient materials for use in the abrasive constructions can be selected from a wide variety of materials. Typically, the resilient material is an organic polymer, which can be thermoplastic or thermoset and may or may not be inherently elastomeric. The materials generally found to be useful resilient materials are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, ethylene/propylene rubbers, butyl rubbers, polybutadienes, polyisoprenes, EPDM polymers, polyvinyl chlorides, polychloroprenes, or styrene/butadiene copolymers. A particular example of a useful resilient material is a copolymer of polyethylene and ethyl vinyl acetate in the form of a foam.

Resilient materials may also be of other constructions if the appropriate mechanical properties (e.g., Young's Modulus and remaining stress in compression) are attained. Polyurethane impregnated felt-based materials such as are used in conventional polishing pads can be used, for example. The resilient material may also be a nonwoven or woven fiber mat of, for example, polyolefin, polyester, or polyamide fibers, which has been impregnated by a resin (e.g. polyurethane). The fibers may be of finite length (i.e., staple) or substantially continuous in the fiber mat.

Specific resilient materials that are useful in the abrasive constructions of the present invention include, but are not limited to, poly(ethylene-co-vinyl acetate) foams available under the trade designations CELLFLEX 1200, CELLFLEX 1800, CELLFLEX 2200, CELLFLEX 2200 XF (Dertex Corp., Lawrence, Mass.), 3M SCOTCH brand CUSHION-MOUNT Plate Mounting Tape 949 (a double-coated high density elastomeric foam tape available from 3M Company, St. Paul, Minn.), EMR 1025 polyethylene foam (available from Sentinel Products, Hyannis, N.J.), HD200 polyurethane foam (available from Illbruck, Inc., Minneapolis, Minn.), MC8000 and MC8000EVA foams (available from Sentinel Products), SUBA IV Impregnated Nonwoven (available from Rodel, Inc., Newark, Del.).

Suprisingly, it has been discovered that commercially available pads, or portions thereof, which have both rigid and resilient elements, used in slurry polishing operations may also be useful as the subpads of the present invention. This discovery is surprising in that the slurry pads are designed to convey loose abrasive particles to the wafer surface and would not have been expected to function as an effective subpad for a fixed abrasive element. Examples of such pads include those available under the trade designations IC 1400, IC2000, or IC1000-SUBA IV pad stacks (available from Rodel, Inc., Newark, Del.).

The abrasive constructions of the present invention can further include means of attachment between the various components, such as between the rigid and resilient elements and between the rigid element and the abrasive element. For example, the construction shown in FIG. 1 is prepared by laminating a sheet of rigid material to a sheet of resilient material. Lamination of these two elements can be achieved by any of a variety of commonly known bonding methods, such as hot melt adhesive, pressure sensitive adhesive, glue, tie layers, bonding agents, mechanical fastening devices, ultrasonic welding, thermal bonding, microwave-activated bonding, or the like. Alternatively, the rigid portion and the resilient portion of the subpad could be brought together by coextrusion.

Typically, lamination of the rigid and resilient elements is readily achieved by use of an adhesive, of the pressure sensitive or hot melt type. Suitable pressure sensitive adhesives can be a wide variety of the commonly used pressure sensitive adhesives, including, but not limited to, those based on natural rubber, (meth)acrylate polymers and copolymers, AB or ABA block copolymers of thermoplastic rubbers such as styrene/butadiene or styrene/isoprene block copolymers available under the trade designation KRATON (Shell Chemical Co., Houston, Tex.), or polyolefins. Suitable hot melt adhesives include, but are not limited to, a wide variety of the commonly used hot melt adhesives, such as those based on polyester, ethylene vinyl acetate (EVA), polyamides, epoxies, and the like. The principle requirements of the adhesive are that it has sufficient cohesive strength and peel resistance for the rigid and resilient elements to remain in place during use, that it is resistant to shear under the conditions of use, and that it is resistant to chemical degradation under conditions of use.

The fixed abrasive element can be attached to the rigid portion of the construction by the same means outlined immediately above—adhesives, coextrusion, thermal bonding, mechanical fastening devices, etc. However, it need not be attached to the rigid portion of the construction, but maintained in a position immediately adjacent to it and coextensive with it. In this case some mechanical means of holding the fixed abrasive in place during use will be required, such as placement pins, retaining ring, tension, vacuum, etc.

The abrasive construction described here is placed onto a machine platen for use in modifying the surface of a silicon wafer, for example. It may be attached by an adhesive or mechanical means, such as placement pins, retaining ring, tension, vacuum, etc.

The abrasive constructions of the present invention can be used on many types of machines for planarizing semiconductor wafers, as are well known in the art for use with polishing pads and loose abrasive slurries. An example of a suitable commercially available machine is a Chemical Mechanical Planarization (CMP) machine available from IPEC/WESTECH of Phoenix, Ariz.

Typically, such machines include a head unit with a wafer holder, which may consist of both a retaining ring and a wafer support pad for holding the semiconductor wafer. Typically, both the semiconductor wafer and the abrasive construction rotate, preferably in the same direction. The wafer holder rotates either in a circular fashion, spiral fashion, elliptical fashion, a nonuniform manner, or a random motion fashion. The speed at which the wafer holder rotates will depend on the particular apparatus, planarization conditions, abrasive article, and the desired planarization criteria. In general, however, the wafer holder rotates at a rate of about 2–1000 revolutions per minute (rpm).

The abrasive construction of the present invention will typically have a diameter of about 10–200 cm, preferably about 20–150 cm, more preferably about 25–100 cm. It may rotate as well, typically at a rate of about 5–10,000 rpm, preferably at a rate of about 10–1000 rpm, and more preferably about 10–250 rpm. Surface modification procedures which utilize the abrasive constructions of the present inventions typically involve pressures of about 6.9–138 kPa.

Various modifications and alterations of this invention will become apparent to those skilled in the art without departing from the scope and spirit of this invention, and it should be understood that this invention is not to be unduly limited to the illustrative embodiments set forth herein.

EXAMPLES

Test Procedures

Young's Modulus (Tensile Modulus)—Test A

The Young's Moduli of the rigid plastic component materials used in the present invention were determined using a static tension test according to ASTM D638-84 (Standard Test Methods for Tensile Properties of Plastics) and ASTM D882-88 (Standard Tensile Properties of Thin Plastic Sheeting). The Young's Modulus of metals was determined substantially according to ASTM E345-93 (Standard Test Methods of Tension Testing of Metallic Foil) except that the gage length was 10.2 cm instead of the specfied 12.7 cm.

Dynamic Compression—Test B

The Young's Moduli of the resilient component materials used in the present invention were determined by dynamic mechanical testing substantially according to ASTM D 5024-94 (Standard Test Method for Measuring the Dynamic Mechanical Properties of Plastics In Compression). The instrument used was a Rheometrics Solids Analyzer (RSA) made by Rheometrics, Inc., Piscataway, N.J. A nominal mean compressive stress of 34.5 kPa was applied to the specimen, then small cyclic loads were superimposed on the static load to determine the dynamic response. Isothermal frequency sweeps were run at 20° C. and 40° C., sweeping between 0.015 Hz and 15 Hz.

Compressive Stress Relaxation Test—Test C

Stress relaxation measurements were determined according to ASTM E 328-86 (Method for Stress Relaxation Tests for Materials or Structures). Circular test samples (20.32 mm in diameter) were placed between two 25.4 mm diameter flat plates as specified in ASTM E 328-86, and the plates preloaded with 25 grams to assure that the upper plate contacted the sample. The upper plate was then displaced toward the fixed lower plate at a rate of 25.4 mm/minute until the load on the sample increased to 2730 grams. On reaching the specified load the displacement of the upper plate was stopped and the relaxation of the stress of the sample recorded during the subsequent 120 seconds.

Materials

The following materials were used in the examples below.

TABLE 1

Rigid Components

| Material | Rigid Components Supplier | Thickness of Sample Tested (mm) | E (MPa) Test A |
|---|---|---|---|
| Polycarbonate | Minnesota Plastics, Minneapolis, MN or Cadillac Plastics, Minneapolis, MN | 0.51 | 1,300 |
| Reinforced Epoxy, FR4 | Minnesota Plastics, Minneapoiis, MN | 0.51 | 16,000 |
| Aluminum | All Foils, Inc., Brooklyn Heights, OH | N.S. | 72,000* |
| IC1000 | Rodel, Inc., Newark, DE | 1.26 | 315 |
| 302 Stainless Steel | Teledyne Rodney, Earth City, MO | N.S. | 193,000* |

*Literature Value
N.S. = not specified

TABLE 2

Resilient Components

| Material | Description | Supplier | Thickness of Sample Tested (mm) | E' (MPa) @ 0.1 Hz/10 Hz Test B | % Stress Remaining Test C |
|---|---|---|---|---|---|
| CELLFLEX 1200 | Poly (ethylene-co-vinyl acetate) foam | Dertex Corporation Lawrence, MA | 3.60 | 2.3/3.4 | 74.52 |
| CELLFLEX 1800 | Poly (ethylene-co-vinyl acetate) foam | Dertex Corporation Lawrence, MA | 3.60 | 5.0/6.0 | 80.40 |
| CELLFLEX 2200 XF | Poly (ethylene-co-vinyl acetate) foam | Dertex Corporation Lawrence, MA | 3.68 | 8.0/12 | 87.10 |
| HD200 | Polyurethane foam | Illbruck, Inc. Minneapolis, MN | 2.30 | 1.8/4.5 | 83.74 |
| SUBA IV | Impregnated Nonwoven | Rodel, Inc., Newark, DE | 1.32 | 3.9/6.4 | 70.55 |

Adhesives useful in preparing the abrasive constructions of the present invention include 442 PC (available as SCOTCH brand Double Coated Tape), 9482 PC (available as SCOTCH brand Adhesive Transfer Tape), and 7961 PC (available as SCOTCH brand Double Coated Membrane Switch Spacer). All of the above adhesives are available from 3M Company, St. Paul, Minn.

Example 1

A polypropylene production tool was made by casting polypropylene resin on a metal master tool having a casting surface comprised of a collection of adjacent truncated 4-sided pyramids. The resulting production tool contained cavities that were in the shape of truncated pyramids. The height of each truncated pyramid was about 80 lm, the base was about 178 μm per side and the top was about 51 μm per side. The cavities were arrayed in a square planar arrangement with a spacing of about 50 cavities per centimeter.

The polypropylene production tool was unwound from a winder and an abrasive slurry (described below) was coated at room temperature into the cavities of the production tool using a vacuum slot die coater. A 76 μm thick poly(ethylene terephthalate) film backing (PPF) primed on one face with an ethylene/acrylic acid copolymer was brought into contact with the abrasive slurry coated production tool such that the abrasive slurry wetted the primed surface of the backing. The abrasive slurry was cured by transmitting ultraviolet light through the PPF backing into the abrasive slurry. Two different ultraviolet lamps were used in series to effect the cure. The first UV lamp was a Fusion System ultraviolet light fitted with a "V" bulb and operated at 236.2 Watts/cm. The second was an ATEK ultraviolet lamp equipped with a medium pressure mercury bulb and operated at 157.5 Watts cm. The production tool was removed from the cured abrasive composite/backing. This process was a continuous process that operated at between about 3.0–7.6 meters/minute.

The abrasive slurry consisted of trimethanolpropane triacrylate (10 parts, TMPTA, available from Sartomer Co., Inc., Exton, Pa. under the designation "Sartomer 351"), hexanediol diacrylate (30 parts, HDDA, available from Sartomer Co., Inc. under the designation "Sartomer 238"), alkyl benzyl phthalate plasticizer (60 parts, PP, available from Monsanto Co., St. Louis, Mo., under the designation "SANTICIZER 278"), isopropyl triisostearoyl titanate coupling agent (6.6 parts, CA3, available from Kenrich Petrochemicals Inc., Bayonne N.J., under the designation "KR-TTS"), 2,4,6-trimethylbenzoyl-diphenyl-phosphine oxide photoinitiator (93.2 parts, PH7, available from BASF, Charlotte, N.C., under the designation "Lucirin TPO"), cerium oxide (165.9 parts, CEO1, average particle size 0.5 μm, treated with an isopropyl triisostearoyl titanate coupling agent, available from Rhone Poulenc, Shelton, Conn.), calcium carbonate (80.93 parts, CACO3, average particle size 4.6 μm, available from Pfizer Speciality Minerals, New York, N.Y. under the designation "USP-EX-HEAVY"), calcium carbonate (7.44 parts, CACO2, average particle size 2.6 μm, available from Pfizer Speciality Minerals under the designation "USP-MEDIUM"), and calcium carbonate (1.85 parts, CACO4, average particle size 0.07 μm, available from Pfizer Speciality Minerals under the designation "MULTIFLEX-MM"). A mixture of TWTA, HDDA, PP, CA3, PH7 and PHI was mixed to obtain a homogeneous blend. CEO1 was gradually added to the blend followed by the gradual addition of the CACO2, CACO3 and CACO4, the resulting mixture stirred until a homogeneous blend was obtained.

The fixed abrasive article described above was laminated to a double coated pressure sensitive adhesive tape (442 PC) having a release liner using 20 passes of a steel hand roller (2.05 kg, 8.2 cm diameter). The release liner was removed and the fixed abrasive article subsequently laminated to an IC1000-SUBA IV slurry polishing pad (available from Rodel Inc.) using 20 passes of the steel hand roller. The laminate was then converted into a wafer polishing pad, for example, by die cutting a 50.8 cm diameter disc.

Example 2

A fixed abrasive was prepared substantially according to the procedure of Example 1 except that poly(ethylene terephthalate) backing was 127 μm thick. A pressure sensitive adhesive double coated tape (442 PC) was laminated to both sides of a piece of polycarbonate sheeting of 0.51 mm thickness using 30 passes of the hand roller described in Example 1. The release liner was removed from one surface of the tape/polycarbonate/tape construction and the fixed abrasive article described above was laminated to the exposed adhesive surface using 20 passes of the hand roller. CELLFLEX 1800 foam (2.3 mm thickness) was laminated to the opposite face of the tapelpolycarbonateltape construction after removal of the release liner using 20 passes of a hand roller. The laminate was then converted into a wafer polishing pad, for example, by die cutting a 50.8 cm diameter disc.

Examples 3–15

All of the following examples of fixed abrasive constructions were prepared in a manner similar to Example 2 where the poly(ethylene terephthalate) backings were either 76 μm or 127 μm thick, except that the resilient and rigid components were changed as indicated in Table 3.

TABLE 3

Subpad Constructions

| Example | Resilient Component | Rigid Component |
|---|---|---|
| 3 | 1.0 mm CELLFLEX 1800 | 0.51 mm Polycarbonate |
| 4 | 2.3 mm CELLFLEX 1200 | 0.51 mm Polycarbonate |
| 5 | 2.3 mm HD 200 | 0.51 mm Polycarbonate |
| 6 | 2.3 mm HD 200 | 0.76 mm Polycarbonate |
| 7 | 2.3 mm CELLFLEX 1 800 | 0.76 mm Polycarbonate |
| 8 | 2.3 mm CELLFLEX 1200 | 0.76 mm Polycarbonate |
| 9 | 2.3 mm HD 200 | 0.38 mm Polycarbonate |
| 10 | 2.3 mm CELLFLEX 2200XF | 0.51 mm FR4 |
| 11 | 2.3 mm CELLFLEX 1800 | 0.51 mm FR4 |
| 12 | 2.3 mm CELLFLEX 2200XF | 0.254 mm FR4 |
| 13 | 2.3 mm HD 260 | 0.20 mm Aluminum |
| 14 | 2.3 mm HD 200 | 0.13 mm Stainless Steel |
| 15 | 2.3 mm CELLFLEX 1800 | 0.13 mm Stainless Steel |

All of the abrasive constructions described in Examples 1–15 were used to modify blanket and patterned wafers and were observed to produce polished wafers having planarity and uniformity values within industry accepted standards when evaluated as polishing pads for blanket and patterned silicon wafers.

All patents, patent documents, and publications cited herein are incorporated by reference as if individually incorporated. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. An abrasive construction comprising a three-dimensional, textured, fixed abrasive element having an abrasive coating comprising a plurality of abrasive composites coextensive with at least one layer of foam with the abrasive construction substantially conforming to a wafer surface global topography while not substantially conforming to a wafer surface local topography during surface modification.

2. The abrasive construction of claim 1 wherein the abrasive element is attached by an adhesive to at least one layer of foam.

3. A method of modifying an exposed surface of a semiconductor wafer, comprising the steps of:

(a) contacting the surface with an abrasive construction comprising a three-dimensional, fixed abrasive element having raised portions and recess portions wherein the raised portions comprises abrasive particles and binder; at least one resilient element generally coextensive with the fixed abrasive element; and at least one rigid element generally coextensive with and interposed between the resilient element and the fixed abrasive element; wherein the rigid element has a Young's Modulus greater than that of the resilient element; and (b) relatively moving the wafer and the abrasive construction thereby modifying the surface of the wafer.

4. The method according to claim 3, wherein the semiconductor wafer surface contacts the surface of the abrasive construction with a pressure of about 6.9–138 kPa.

5. The method according to claim 3 wherein the abrasive construction has a diameter of about 10–200 cm.

6. The method according to claim 3 wherein the abrasive construction has a diameter of about 25 to 100 cm.

7. The method according to claim 3 wherein the abrasive construction moves relative to the wafer by rotating at a rate of about 5 to 10,000 revolutions per minute.

8. The method according to claim 3 wherein the abrasive construction moves relative to the wafer by rotating at a rate of about 10 to 250 revolutions per minute.

9. A method of modifying an exposed surface of a semiconductor wafer, comprising the steps of:

(a) contacting the surface with an abrasive construction comprising a three-dimensional, textured, fixed abrasive element having an abrasive coating comprising a plurality of abrasive composites coextensive with a layer of foam; and (b) relatively moving the wafer and the abrasive construction thereby modifying the surface of the wafer.

10. The method according to claim 9, wherein the semiconductor wafer surface contacts the surface of the abrasive construction with a pressure of about 6.9–138 kPa.

11. The method according to claim 9 wherein the abrasive construction has a diameter of about 10–200 cm.

12. The method according to claim 9 wherein the abrasive construction has a diameter of about 25 to 100 cm.

13. The method according to claim 9 wherein the abrasive construction moves relative to the wafer by rotating at a rate of about 5 to 10,000 revolutions per minute.

14. The method according to claim 9 wherein the abrasive construction moves relative to the wafer by rotating at a rate of about 10 to 250 revolutions per minute.

* * * * *